US005188068A

United States Patent [19]

Gaterman, III et al.

[11] Patent Number: 5,188,068

[45] Date of Patent: Feb. 23, 1993

[54] ROLLER TAPPET

[75] Inventors: William C. Gaterman, III; William A. Pohle, both of Daytona Beach, Fla.

[73] Assignee: Crane Cams, Daytona Beach, Fla.

[21] Appl. No.: 879,722

[22] Filed: May 6, 1992

Related U.S. Application Data

[63] Continuation of Ser. No. 649,969, Feb. 4, 1991, abandoned.

[51] Int. Cl.[5] ..... F01L 1/14

[52] U.S. Cl. ..... 123/90.35; 123/90.5; 74/569

[58] Field of Search ..... 123/90.35, 90.48, 90.5, 123/90.55; 74/569

[56] References Cited

U.S. PATENT DOCUMENTS

| | | | |
|---|---|---|---|
| 2,091,674 | 8/1937 | Dostal | 123/90.48 |
| 2,846,988 | 8/1958 | Iskenderian | 123/90.5 |
| 3,089,472 | 5/1963 | Thompson | 123/90.5 |
| 3,108,580 | 10/1963 | Crane | 123/90.5 |
| 3,139,076 | 6/1964 | Flaherty | 123/90.5 |
| 3,234,815 | 2/1966 | Line | 74/569 |
| 3,267,918 | 8/1966 | Ayres | 123/90.35 |
| 3,273,547 | 9/1966 | Lesher | 123/90.35 |
| 3,430,613 | 3/1969 | Barnes | 123/90.35 |
| 3,439,660 | 4/1969 | Lesher | 123/90.35 |
| 3,886,808 | 6/1975 | Weber | 123/90.48 |
| 3,977,370 | 8/1976 | Humphreys | 123/90.5 |
| 4,094,279 | 6/1978 | Kueny | 123/90.51 |
| 4,173,954 | 11/1979 | Speckhart | 123/90.5 |
| 4,231,267 | 11/1980 | Van Slooten | 123/90.48 |
| 4,361,120 | 11/1982 | Kueny | 123/90.55 |
| 4,607,599 | 8/1986 | Buente et al. | 123/90.55 |
| 4,809,651 | 3/1989 | Gerchow et al. | 123/90.5 |
| 4,885,952 | 12/1989 | Connell et al. | 123/90.48 |

*Primary Examiner*—E. Rollins Cross
*Assistant Examiner*—Weilun Lo
*Attorney, Agent, or Firm*—Cushman, Darby & Cushman

[57] ABSTRACT

A valve tappet for actuating a valve lifter in an internal combustion engine. The present invention has greater strength and improved oil flow control as compared to conventional tappets. The present invention achieves these objectives through a design that maintains essentially continuous contact with the internal surface of the lifter bore throughout the entire length of the tappet. Throughbores are formed in the tappet body allowing oil flow therethrough. The resulting tappet does not have the abrupt edges associated with conventional tappet designs, this also minimizes scuffing of the lifter bore, an additional problem associated with conventional tappets.

3 Claims, 2 Drawing Sheets

ROLLER TAPPET

This is a continuation of application Ser. No. 07/649,969, filed on Feb. 4, 1991, which was abandoned upon the filing hereof.

BACKGROUND OF THE INVENTION

1. Field of the Invention

This invention relates to valve tappets in internal combustion engines. More specifically, the present invention is an improvement in valve tappet design that eliminates many of the problems found in conventional valve tappets.

2. Description of the Related Art

It is well known to utilize roller tappets for valve actuation in internal combustion engines. These tappets allow increased engine speeds with less wear and energy dissipation. A typical roller tappet has a cylindrical body with a bifurcated portion at one end for receiving the roller and its associated shaft. The roller follows a cam causing the tappet to reciprocate in a bore of the engine block. The movement of the tappet controls the movement of an associated valve. In order to increase the flow of oil for adequate lubrication, conventional valve tappets have provided a centralized groove machined circumferentially into a portion of the tappet body. Such a tappet is disclosed in U.S. Pat. No. 4,809,651 issued to Gerchow.

There are several problems associated with conventional valve tappets of the type disclosed by Gerchow. FIGS. 1-3 illustrate a conventional roller tappet. Tappet 2' has body 4' and roller 10' as well as lifter rod seat 8'. The groove formed in the center of body 4' inherently defines edges 7 at its interface with the tappet body. This can be the source of scuffing of the lifter bore when the tappet is subject to typical side thrust loads. Also, because of the decreased diameter at the grooved portion of the tappet, the tappet structure is weakened and may bend in the bore when subject to extreme forces. This causes engine failure requiring that the engine block be disassembled in order to remove the bent tappet. Furthermore, the conventional tappet design does not always allow for adequate lubrication under extreme conditions because the oil can only pass on either side of central groove 5.

SUMMARY OF THE INVENTION

The present invention is directed to providing an improved design for roller tappets. In particular it is an object of the present invention to provide a tappet with greater strength than conventional tappets. It is another object of the present invention to provide a tappet that allows superior lubrication as compared to conventional tappets. It is still another object of the present invention to provide a tappet that maintains essentially continuous contact along the length of the bore thus avoiding problems of scuffing associated with conventional tappets.

The present invention utilizes a series of cross bores drilled into the body of the tappet to provide for oil flow through the lifter galley. This allows for more complete lubrication than the centralized groove of conventional tappets. The cross bores may be of various sizes, quantities and configurations in order to provide for metered oil flow control and adaptation to particular applications, i.e. different engines and different duty cycles. In addition, a removable jet may be inserted into the cross bores for more precise control of oil flow.

In addition, the use of cross bores as opposed to a central groove eliminates the problem of scuffing in the lifter bore when the tappet is subject to extreme side thrusts, which is often the case during operation. This is so because there is a substantially continuous surface, along the entire length of the tappet, in contact with the inner surface of the lifter bore. Indeed, there is no abrupt edge to cause scuffing as is found in conventional tappets.

Also, because the resulting support of the tappet body is located at the outer periphery, as opposed to the center, as in conventional tappets with a circumferential groove, the moment of inertia about the vertical axis of the tappet is greater. Since bending strength is proportional to the moment of inertia, the tappet of the subject invention is less susceptible to bending when subject to extreme forces.

Other objects, features and characteristics of the present invention, as well as the methods of operation and function of the related elements of the structure, and the combination of parts and economies of manufacture, will become more apparent upon consideration of the following detailed description and the appended claims with reference to the accompanying drawings, all of which form a part of this specification.

DETAILED DESCRIPTION OF THE PREFERRED EMBODIMENT

Figure 4:
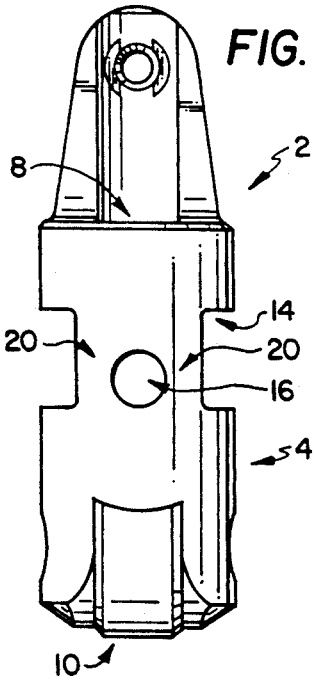
FIG. 4 is a side view of a roller tappet provided in accordance with a first embodiment of the invention.
Figure 5:
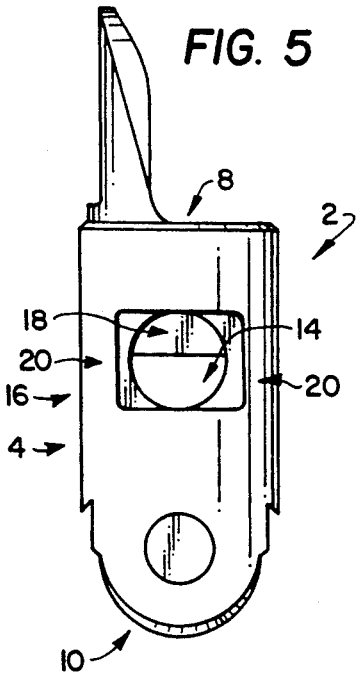
FIG. 5 is a side view of the tappet of FIG. 4 rotated 90 degrees.
Figure 6:
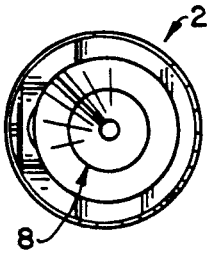
FIG. 6 is a top view of the tappet of FIG. 4.

FIGS. 4-6 illustrate a first embodiment of the present invention. Roller tappet 2 is adapted to connection with a valve lifter rod (not illustrated) at its top portion. Valve lifter seat 8 is formed in body 4 to receive the end of the lifter rod. Body 4 has a bifurcated portion at its bottom end for supporting wheel 10 which is rotatably mounted in the bifurcated portion by virtue of pin 12.

Figure 1:
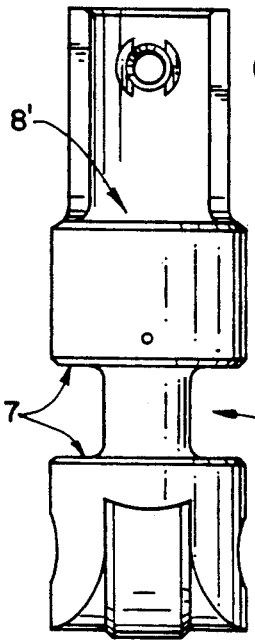
FIG. 1 (PRIOR ART)
FIG. 1 is a side view of a conventional tappet.
Figure 2:
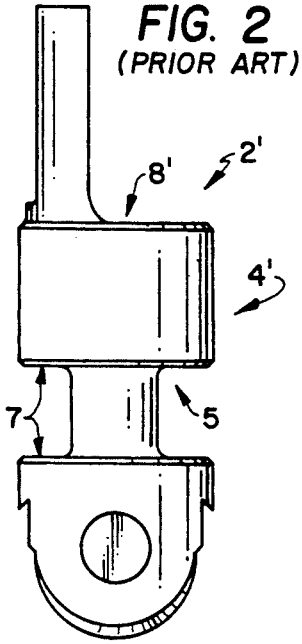
FIG. 2 (PRIOR ART)
FIG. 2 is a side view of the conventional tappet of FIG. 1 rotated 90 degrees.
Figure 3:
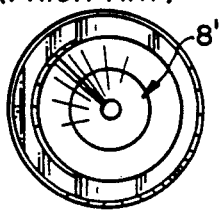
FIG. 3 (PRIOR ART)
FIG. 3 is a top view of the conventional tappet of FIG. 1.

Two cross bores 14 and 16 are drilled through a central portion of body 4 with their axis at right angles to each other and the vertical axis of body 4. This leaves four support members 20 in body 4 while allowing oil to flow completely through body 4. Note that in contrast to prior art designs (see FIG. 1-3) there are no abrupt edges, in the plane of cam rotation in body 4 at its interface with the lifter bore 30 (not illustrated). This minimizes the possibility of scuffing of the inner surface of the lifter bore due to the reciprocating motion of tappet 2. Since side thrusts, due to cam rotation will be in the plane of cam rotation, the smaller cross bore 16 is drilled with its axis in the plane of cam rotation, thus minimizing any abrupt edge that may be formed on portions of the tappet subject to side thrust if a larger hole was drilled.

In operation, roller 10 follows the irregular surface of a rotating cam (not illustrated), causing tappet 2 to reciprocate vertically within bore 30. This means that tappet 2 reciprocates once for each revolution of the timing shaft. This can be several thousand cycles per minute or more. The surface of the cam places a complex combination of varying compressive, bending and shear forces on body 4.

The novel construction of the present invention allows it to stand up to these forces more reliably than tappets found in the prior art. More particularly, side thrusts caused by the cam surface acting on roller 10 will press body 4 against one side of the inner surface of bore 30. Because body 4 has no abrupt edges on the surface subject to pressure due to side thrust, and is in contact along its entire length with the inner surface of bore 30 along the portions of body 4 that contain supporting members 20, there is little scuffing.

The subject invention can be constructed in various configurations utilizing machining techniques other than drilling. For example, portions of the tappet body can be removed through milling, or the like, resulting in a multitude of shapes or configurations. Further, the resulting voids in the tappet body need not extend completely through the tappet. Although it would be preferable that at least one of such voids does allow oil to pass completely through the tappet body. In addition, salient portions, such as salient portion 18, may be left in the tappet for strengthening purposes, or for the control of oil flow, as desired. A T-shaped oil bore of the type known and used in the prior art structure of FIGS. 1–3, the stem of which passage is illustrated in FIG. 6, or a straight bore of the type typically provided in hollow tappets could be incorporated in the tappet of the invention. Such bores are notoriously well known and, without more, do not constitute a part of this invention. In summary, the configuration of the tappet can take on a multitude of designs in order to meter oil flow for a particular application. As long as there is a substantially continuous surface along the length of the tappet body in contact with the lifter bore, the advantages of the present invention will be realized.

Figure 7:
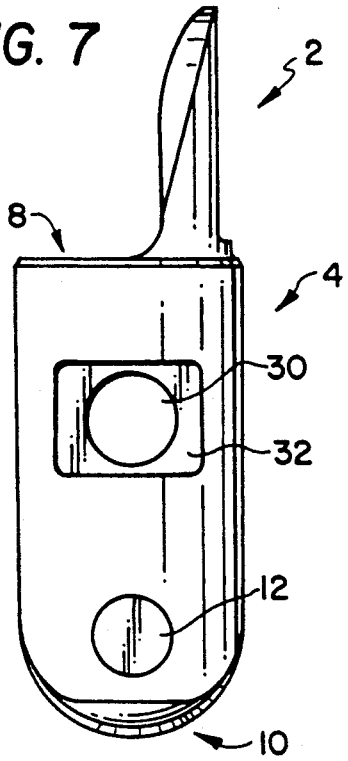
FIG. 7 is a side view of a roller tappet provided in accordance with a second embodiment of the invention.
Figure 8:
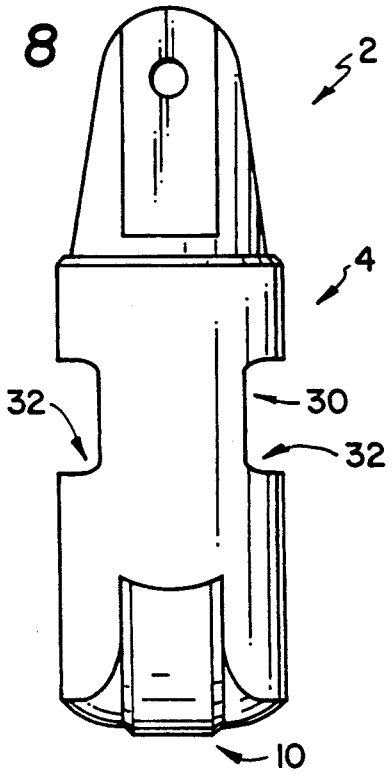
FIG. 8 is a side view of the tappet of FIG. 7 rotated 90 degrees.

Thus, for example, in accordance with an alternate embodiment of the invention, FIGS. 7 and 8 illustrate a second embodiment of the invention in which only a single cross bore 30 is formed in tappet body 4. Similar parts of this embodiment are labeled with the same reference numerals as in FIGS. 4–6. Notice that while only one cross bore 30 is formed in body 4 of the second embodiment, cavities 32 are formed around each end of cross bore 30 resulting in improved oil flow.

Most importantly, however, is the fact that the surface of body 4 is continuous along the length of body 4 at portions subject to the greatest side thrusts, i.e. portions of body 4 lying in planes that are almost perpendicular to the plane of rotation of the cam (not illustrated). Since the surface is continuous, with no abrupt edges, scuffing is not likely to occur. In addition, the second embodiment is also less likely to bend under extreme forces because of the high moment of inertia of a cross section of body 4 about the vertical axis of tappet 2, as compared to conventional tappet designs.

Figure 9:
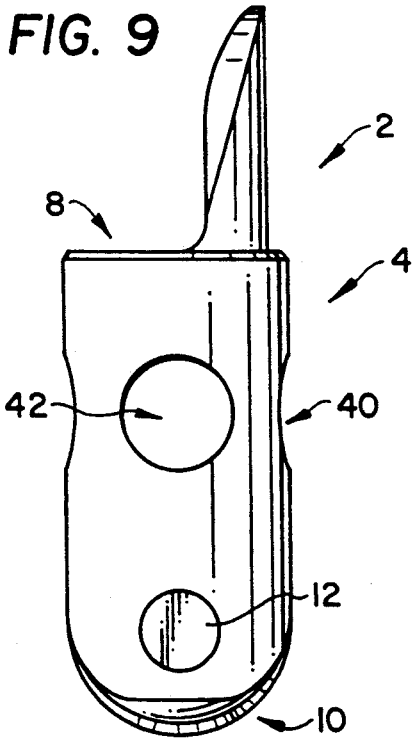
FIG. 9 is a side view of a roller tappet provided in accordance with a third embodiment of the invention.
Figure 10:
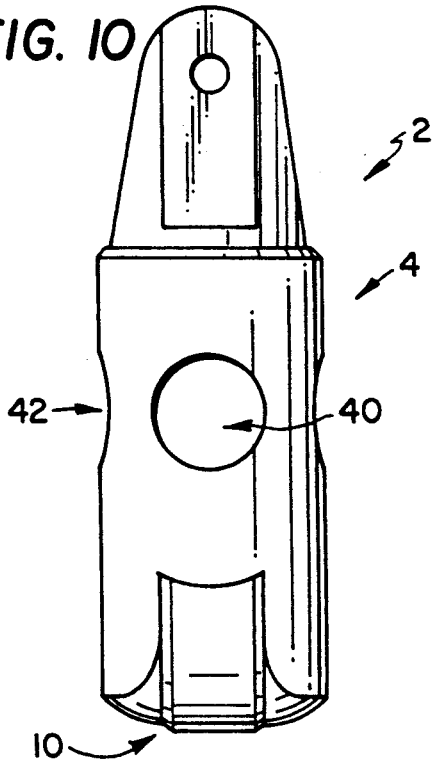
FIG. 10 is a side view of the tappet of FIG. 9 rotated 90 degrees.

FIGS. 9 and 10 illustrate a third embodiment of the present invention. Similar parts of this embodiment are also labeled with the same reference numerals as in FIGS. 4–6. In this embodiment, two cross bores 40 and 42, of approximately equal radius, are drilled in body 4 with their axis at right angles to each other and to the vertical axis of tappet 4. Note that there are no other portions of body 4 removed through machining, other than the two cross bores 40 and 42. The design of this embodiment also essentially eliminates abrupt edges along the entire length of body 4.

While the invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

What is claimed is:

1. A valve tappet for internal combustion engines, adaptable to reciprocating movement within a bore formed in an engine block, comprising:

a first cylindrical body portion having first and second longitudinal ends and being adaptable for connection to a valve lifter at said first longitudinal end;

a second cylindrical body portion having first and second longitudinal ends; and a central portion connecting said second longitudinal end of said first body portion and said first longitudinal end of said second body portion said central portion including a first bore, a second bore disposed perpendicularly to said first bore, planar cutout portions spaced from and parallel to said first bore and intersecting said second bore, and said second bore having a maximum diameter greater than a maximum diameter of said first bore, whereby a salient portion is defined above said first bore and intersects a portion of said second bore;

said first and second cylindrical body portions having substantially the same maximum outer radius and at least a portion of central portion having a radially outer surface having an outer radius substantially equal to said maximum outer radius of said cylindrical body portions extending along substantially the entire length thereof.

2. A valve tappet as claimed in claim 1 wherein said second longitudinal end of said second body portion has a bifurcated portion formed thereon and a roller element rotatably mounted in said bifurcated portion.

3. A valve tappet for internal combustion engines, adaptable to reciprocating movement within a lifter bore formed in an engine block, comprising:

a cylindrical body having first and second longitudinal ends and a longitudinal axis, said first longitudinal end being adaptable for connection with a valve lifter and said second longitudinal end being bifurcated;

a roller element rotatably mounted to said second longitudinal end;

at least one throughbore defined through said cylindrical body, said throughbore having an axis substantially perpendicular to said longitudinal axis; and first and second cutout portions, said first and second cutout portions being spaced apart from each other and each having a longitudinal axis perpendicular to and intersecting with said throughbore;

at least a portion of a radially outermost surface of said cylindrical body having a substantially constant radius along substantially the entire length of said cylindrical body.

* * * * *